US005823128A

United States Patent [19]

Lapidus

[11] Patent Number: 5,823,128

[45] Date of Patent: Oct. 20, 1998

[54] METHOD FOR PRODUCING A FLAP POCKET AND AN ITEM HAVING THE FLAP POCKET

[75] Inventor: Olivier Lapidus, Neuilly Sur Seine, France

[73] Assignee: Ted Lapidus, France

[21] Appl. No.: 647,985

[22] PCT Filed: Nov. 29, 1994

[86] PCT No.: PCT/FR94/01385

§ 371 Date: May 29, 1996

§ 102(e) Date: May 29, 1996

[87] PCT Pub. No.: WO95/14399

PCT Pub. Date: Jun. 1, 1995

[51] Int. Cl.[6] ..... D05B 13/00; A41D 27/20

[52] U.S. Cl. ..... 112/475.06; 112/475.09; 2/247

[58] Field of Search ..... 112/475.06, 475.09, 112/122.1, 405, 418, 417, 423; 2/247, 251, 248

[56] References Cited

U.S. PATENT DOCUMENTS

| | | | |
|---|---|---|---|
| 709,460 | 9/1902 | Bartell | 2/248 |
| 2,524,879 | 10/1950 | Capuano | 2/247 |
| 2,544,750 | 3/1951 | D'Alesio | 2/247 |
| 3,451,065 | 6/1969 | Augustin | 112/475.09 X |
| 3,602,914 | 9/1971 | Castello | 2/247 |

FOREIGN PATENT DOCUMENTS

| | | |
|---|---|---|
| 2110833 | 6/1972 | France . |
| 642167 | 8/1950 | United Kingdom . |
| 870228 | 6/1961 | United Kingdom . |

*Primary Examiner*—Ismael Izaguirre
*Attorney, Agent, or Firm*—Adams & Wilks

[57] ABSTRACT

A method for producing a flap pocket in a panel of an item comprises forming in the panel a slit having a preselected contour to define a flap having a body integral with the panel. An aperture is formed in the panel at a location outside of the slit. Thereafter, a pocket having a lateral opening is attached around the aperture so that the lateral opening is positioned over the flap.

32 Claims, 5 Drawing Sheets

FIG_6
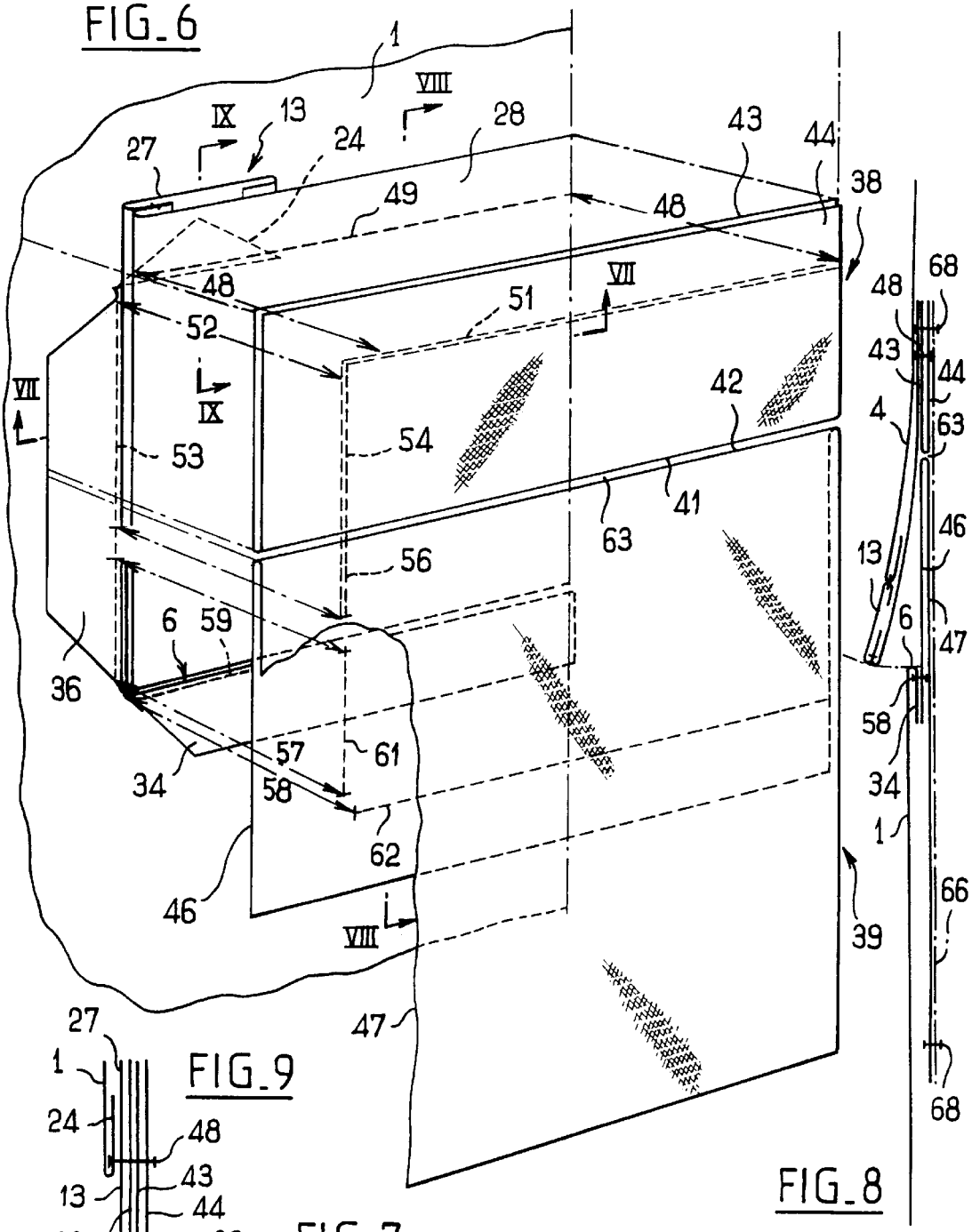
FIG_9
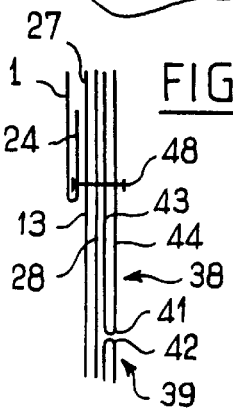
FIG_7
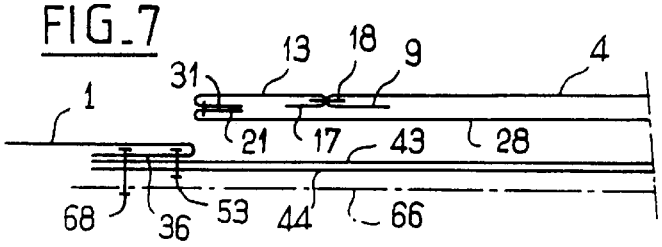
FIG_8

FIG_10
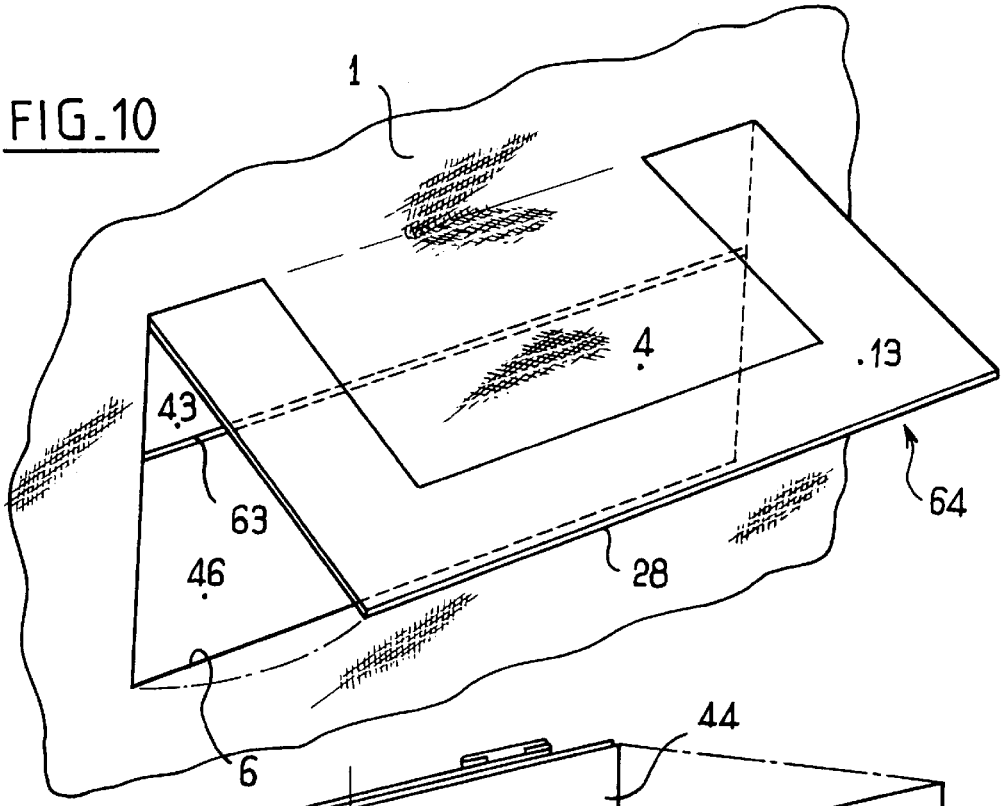
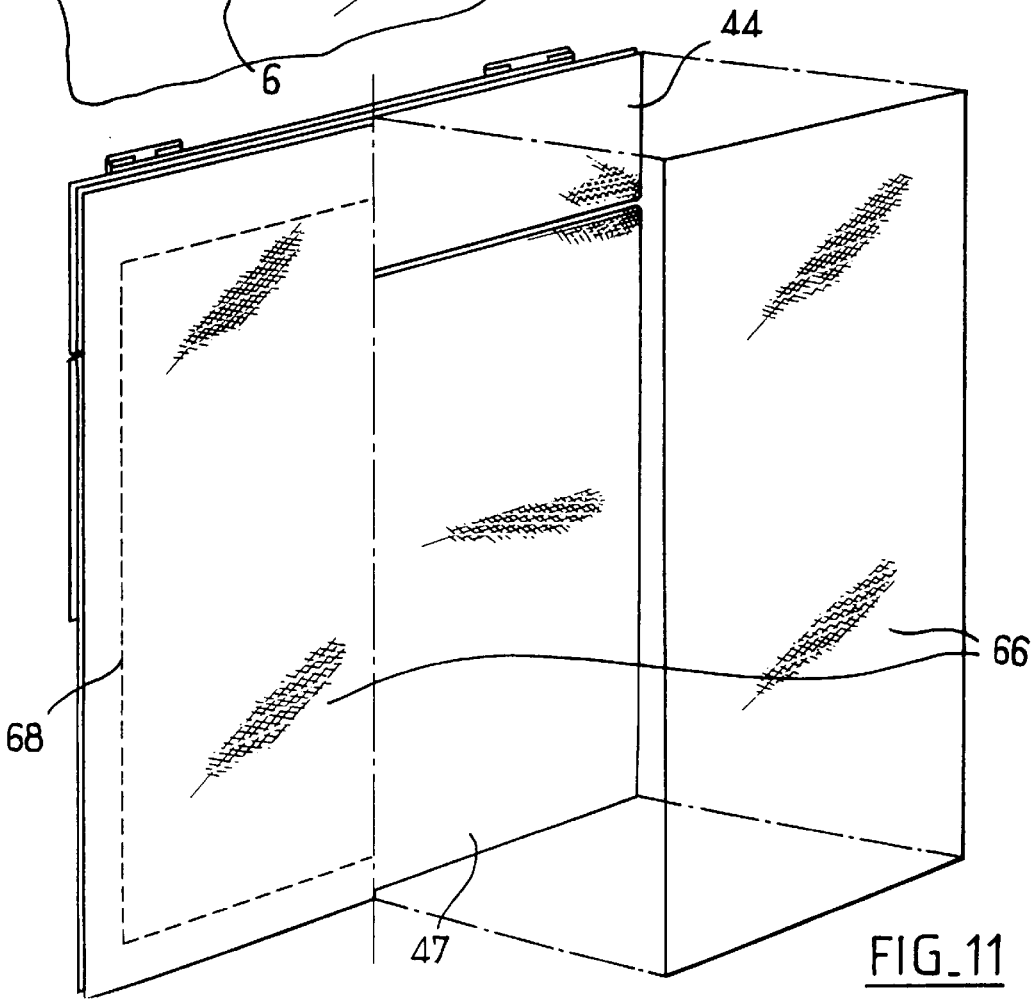
FIG_11

METHOD FOR PRODUCING A FLAP POCKET AND AN ITEM HAVING THE FLAP POCKET

BACKGROUND OF THE INVENTION

1. Field of the Invention

The present invention relates to a method for producing a flap pocket in a garment panel.

The present invention also relates to an item, such as a garment, bag, suitcase or similar item, comprising such a pocket.

2. Background Information

In order to produce such a flap pocket, it is known to form a straight slit in the material of the panel of the garment or other item and to attach a flap along the upper edge of the slit.

This method has various disadvantages. From the aesthetic point of view, the flap forms a break with respect to the garment panel, and it does so for three reasons: the stitching of the flap emphasises the separation, the texture and/or the pattern of the material of the flap are not strictly aligned with those of the garment panel, and the flap has a tendency to stay open, that is to say, to be placed in an oblique position with respect to the garment panel. Furthermore, the attaching of the flap to the garment panel can lack strength and/or water-tightness.

SUMMARY OF THE INVENTION

An object of the invention is therefore to propose a pocket structure and a method for producing it which overcome the disadvantages mentioned above.

According to the invention, the method for producing a flap pocket in a panel of an item is characterized in that it comprises the following steps:

a) forming, in the material of the item panel, a slit having a U-shaped contour in such a way as to define, inside the U, a flap body which is integral with the item panel, and forming, outside of the U, an aperture in the item panel; and b) attaching around the aperture a pocket having a lateral opening positioned such that it is under the flap.

Thus, rather than preserving the material of the garment panel or other item panel intended to be under the flap, and which is consequently invisible unless the flap is raised, the invention foresees producing the flap in one piece with the material of the garment panel. On the other hand, an aperture is formed in the garment panel but this aperture may be both partially closed by the pocket and at least partially concealed by the flap.

Preferably, in order to better conceal the whole of the aperture, or a bigger portion of the latter, there is attached along the mobile edges of the flap body a flap edging which enlarges the flap with respect to the dimensions of the U-shaped slit.

According to a preferred embodiment of the method, there is attached, for example to the flap edging, a counter flap covering the inside face of the flap body.

The pocket can then also be attached to the counter flap in the vicinity of or above a line substantially corresponding to the axis of articulation of the flap with the item panel.

According to another object of the invention, the item comprising a flap pocket obtained in particular by a method according to the invention is characterized in that the flap comprises a flap body which extends the panel of the item containing the pocket and is formed in a single piece of material with said panel, whilst the material of the item panel has an aperture under the flap.

BRIEF DESCRIPTION OF THE DRAWINGS

Other features and advantages of the invention will emerge from the following description relating to non-limitative embodiments.

In the accompanying drawings:

FIGS. 5 and 6 are perspective half-views of two other steps of the method, seen from the inside of the item;

FIGS. 7, 8 and 9 are cross-sections along VII—VII, VII, VIII—VIII and IX—IX respectively of FIG. 6;

FIG. 10 is a perspective view of the result of the operation shown in FIG. 6, seen from the outside of the item;

FIG. 11 is a perspective view seen from inside the item showing the pocket bottom during fitting (right hand section of the figure) and fitted (left hand section of the figure) respectively;

DETAILED DESCRIPTION OF THE PREFERRED EMBODIMENTS

Figure 1:
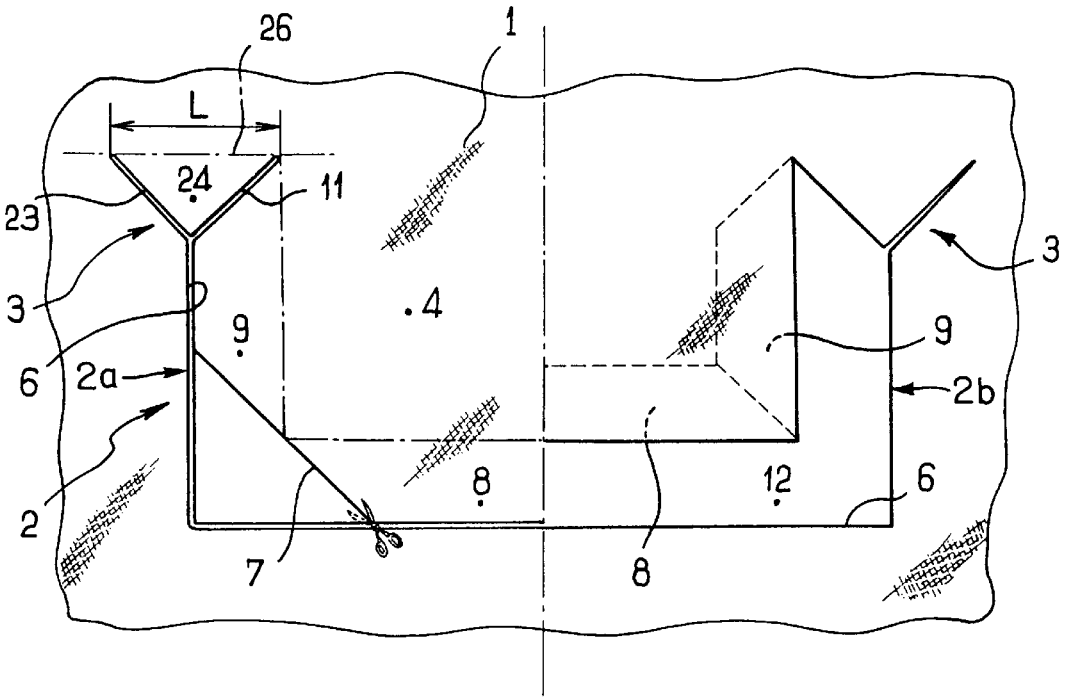
FIG. 1 shows, in half-views in its left-hand and right-hand sections, two successive steps of the method according to the invention.
Figure 2:
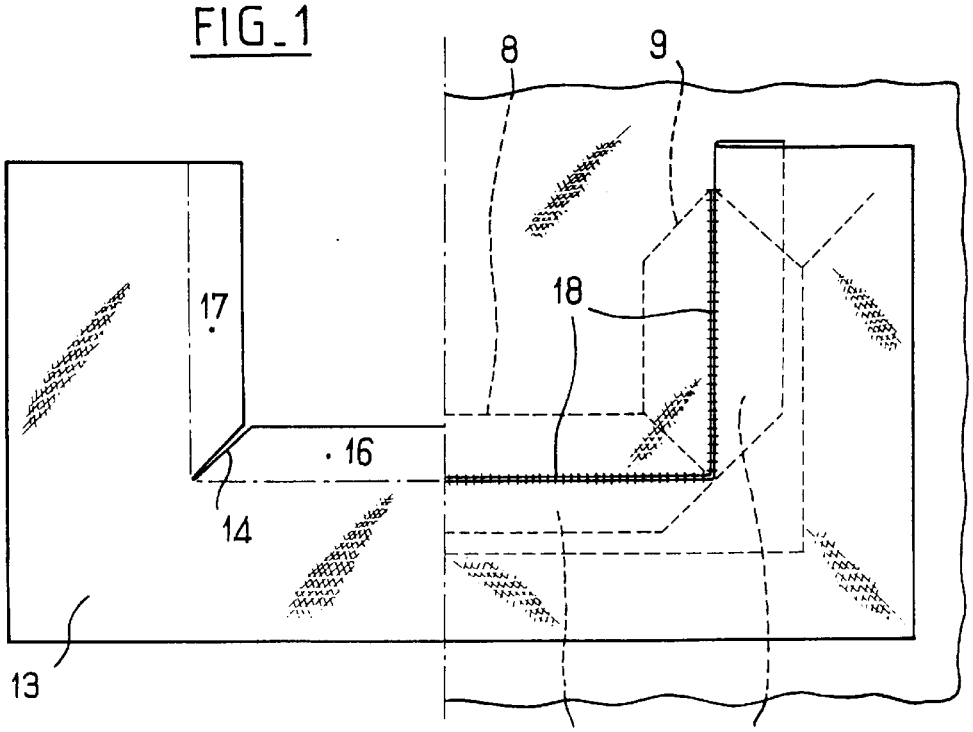
FIG. 2 shows, in the right-hand half-view, a third step of the method, and in the left-hand half-view, a piece of edging used in this third step.

In the embodiment shown in FIGS. 1 to 11, a, garment, taken as an example of an item, comprises a panel 1 (FIG. 1), in which there is formed, for example by means of a punch, a slit 2 which is generally U-shaped and whose leg portions 2*a*, 2*b* have free ends 3 directed upwards and forked into a Y-shape. The U-shaped slit 2 defines, inside the U, a flap body 4 and, outside the U, an aperture 6 in the garment panel 1. Although the slit in the present invention is described as having a contour in the shape of a U, it is understood that the slit could have any contour that may be desired for aesthetic or other reasons.

The two corners of the flap body 4 are then cut like a bevel 7 in order to define around the flap body 4 a central tab 8 and two lateral tabs 9. The central tab 8 is defined between the two bevels 7. Each lateral tab 9 is defined between one of the bevels 7 and the inside arm 11 of the corresponding forked end 3.

Then, as shown in the right hand section of FIG. 1, the tabs 8 and 9 are turned through 180° against the inside of the flap body 4. This causes a U-shaped opening 12 to appear between the aperture 6 and the flap body 4.

A flap edging 13 is prepared separately and made from a piece of flat material which is generally U-shaped. In this piece of flat material, there is made a sloped slit 14 starting from each of its two concave corners in order to define a central internal tab 16 and two internal lateral tabs 17. As shown in the right hand section of FIG. 2, the three internal tabs 16 and 17 are turned through 180° and this gives the edging 13 an internal contour corresponding exactly with the external contour of the flap body 4 with the tabs 8 and 9 turned back. However, the two arms of the edging 13 are longer than the corresponding lateral edges of the flap body 4.

The flap edging 13 is placed around the flap body 4 in such a way that the tabs 16 and 17 of the edging flap 13 are turned back on the same side as the tabs 8 and 9 with respect to the plane of the flap body 4 and of the flap edging 13. The flap edging 13 is then connected to the flap body 4 by stitching 18 formed along the mobile edges of the flap body 4. The stitching 18 (see also FIG. 7) is carried out substantially in the plane of the flap body 4 and of the flap edging 13 and it connects the folds, located back to back, of the flaps 8 and 9 on the one hand and 16 and 17 on the other hand.

Figure 3:
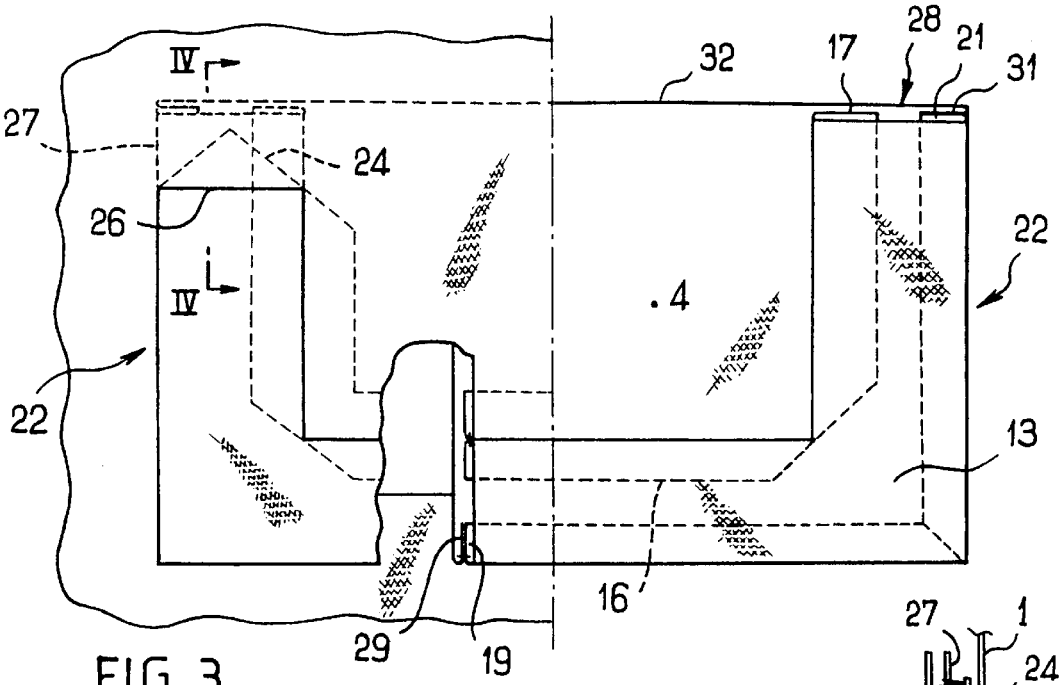
FIG. 3 shows a fourth step of the method according to FIG. 1, only the flap edging and the counter flap being shown in the right hand section of the figure.
Figure 4:
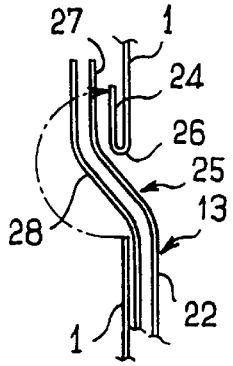
FIG. 4 is a cross-sectional view along IV—IV of FIG. 3.

Then, as shown in FIG. 3, there is formed, by folding back the flap edging 13 through 180° on the same side as the internal tabs 16 and 17, a peripheral central tab 19 and two peripheral lateral tabs 21. By this operation, the width of the arms 22 of the edging 13 is reduced such that it is substantially equal to the width L (FIG. 1) of the Y formed by each forked end 3 of the U-shaped slit 2. Each forked end 3 defines between its inside branch 11 and its outside branch 23, a triangular neatness flap 24. The flaps 24 are turned back (FIGS. 3 and 4) towards the inside of the garment panel, by rotation through 180° about an axis 26, in such a way as to release an opening 25 (FIG. 4) in the garment panel at each forked end of the U-shaped slit. The end region 27 of the corresponding arm 22 of the flap edging 13 is then engaged in each opening 25. This end region 27 is therefore then on the internal side of the garment panel, see also FIG. 4.

At this stage, a counter flap 28 which covers the entire rear surface of the flap body 4 and of the flap edging 13 is attached to the peripheral tabs 19 and 21 of the flap edging 13. The counter flap 28 itself has a peripheral central tab 19 and two peripheral lateral tabs 31 by which it is attached to the peripheral tabs 19 and 21 respectively of the flap edging 13. The upper edge 32 of the counter flap 28 substantially coincides with the upper end of the arms 22 of the flap edging 13.

Figure 5:
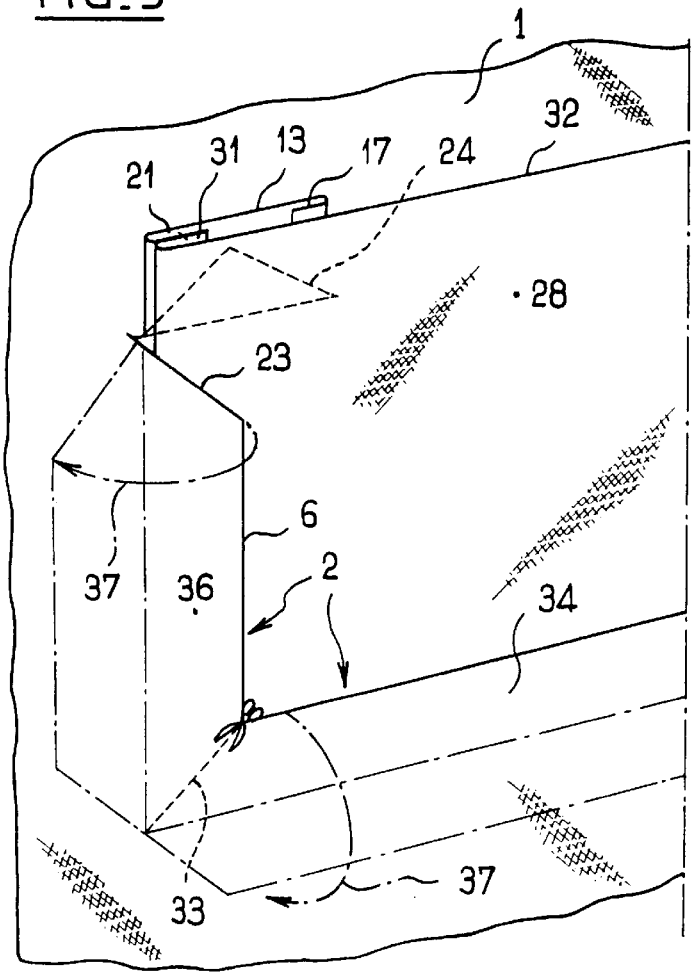

FIG. 5 shows the situation seen from the inside of the garment panel 1 after the operations which have just been described. In the garment panel 1 there are produced, starting from the concave corners of the aperture 6, oblique cuts 33 which define along the aperture 6 a central tab 34 and two lateral tabs 36 which are turned through 180° against the inside face of the garment panel 1 as indicated by the circular arrows 37.

FIG. 6 also shows the situation seen from the rear of the garment panel. Facing the counter flap 28 and the turned back tabs 34 and 36 of the aperture of the garment panel 1, there are presented two pieces of fabric 38, 39, folded through 180° in such a way that their folds 41 and 42 are located facing each other with the fabric of each piece extending away from the other piece starting from the respective fold. With regard to the piece 38, the fold 41 forms the limit between an upper face panel 43 of the pocket and an outer upper panel 44 of the pocket. With regard to the part 39, the fold 42 forms the limit between a lower face panel 46 of the pocket and a lower cuter panel 47 of the pocket. The face panels 43 and 46 are located between the counter flap 28 and the outer panels 44 and 47.

The upper face panel 43 and the upper outer panel 44 are connected to the counter flap 28 by central stitching 48, and to the tabs 36 by two lateral stitchings 52 (only one of which is visible in FIG. 6). The stitching 48 extends along a line 49 of the counter flap 28 adjacent to the future axis of articulation of the flap with respect to the garment panel 1, and along a corresponding line 51 of the upper face panel 43 and of the upper outer panel 44 of the pocket. The stitching 48 will at the same time connect the ends 27 of the edging 13 and the neatness flaps 24 to the counter flap 28 and the piece 38, see also FIG. 9. Each stitching 52 connects both the articulation line 53 of the corresponding tab 36 and a corresponding line 34 of the upper face panel 43 and of the upper outer panel 44. The line 54 furthermore comprises an extension 56 across the lower face panel 46 and the lower outer panel 47, such that the stitchings 52 also contribute to attaching the lower face panel 46 and the lower outer panel 47 to the periphery of the aperture 6. Thus the two pieces 38 and 39 are positioned accurately with respect to each other.

Furthermore, stitchings 57 and 58 connect the lower part of the articulation line 53 of the tab 36 and the articulation line 59 of the central tab 34 of the aperture 6 with corresponding lines 61 and 62, respectively, of the lower face panel 46. The stitchings 57 and 58 do not concern the lower outer panel 47 of the pocket.

Thus, the assembly formed by the two face panels 43, 46 and the outer panels 44, 47 of the pocket is attached over the entire periphery of the aperture, directly to the material of the garment panel along the open edges of the aperture, and to the counter flap 28 along that edge of the aperture from where the flap starts.

The folds 41 and 42 define between them, for the user raising the flap, a lateral opening 63 giving access to the inside of the pocket.

FIG. 10 shows the structure obtained as seen from the outside of the garment, the flap 64 being shown raised, allowing the appearance, through the aperture 6, of the upper face panel 43, the lower race panel 46 and the lateral opening 63 situated between them. The body 4 of the flap 64 has no discontinuity with respect to the garment panel 1, in particular because the stitching 48 shown in FIG. 6 has not concerned the material of the garment panel 1. When the flap 64 is folded down, it conceals the face panels 43, 46 and the opening 63.

Then, as shown in FIG. 11, the pocket is finished by attaching a rectangular pocket inner panel 66 both to the upper outer and lower outer panels 44 and 47 by means of peripheral stitching 68 which can also concern the face panels 43 and 46, the tabs 36, the counter flap 28 along the articulation line between the flap and the garment panel, the ends 27 of the edging 13, and the neatness flaps 24. The stitching 68 can also be seen in FIGS. 7 and 8, where the pocket inner panel 66 is shown in dotted and dashed line to make it easier to distinguish the situations before and after its positioning. It has been so arranged that the stitching 68 never concerns the visible material of the garment panel. Thus, after fitting the pocket inner panel, the external appearance of the garment is still as shown in FIG. 10.

Figure 12:
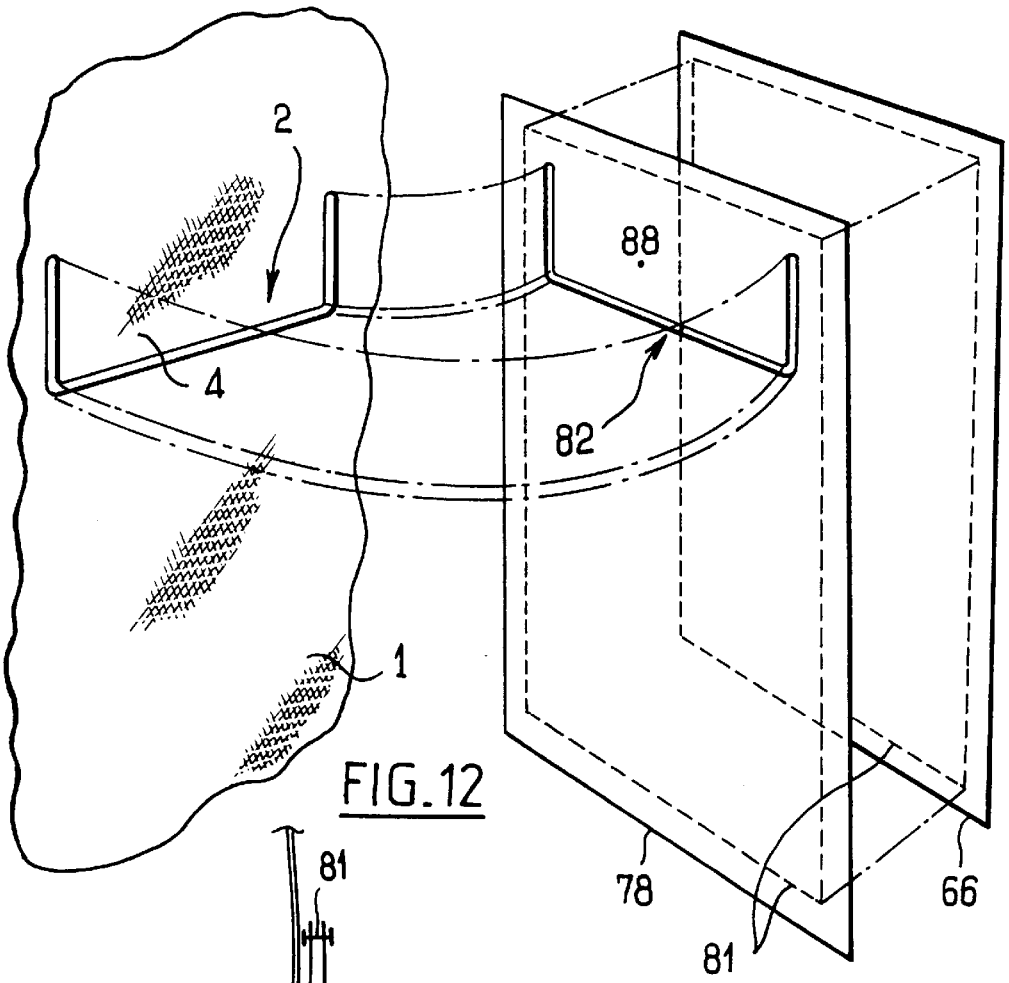
FIG. 12 is a perspective view showing the assembly to be produced for a second embodiment of the invention.
Figure 13:
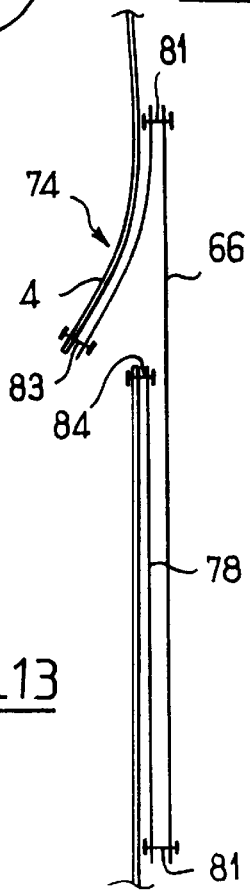
FIGS. 13 and 14 are vertical cross-sectional and external perspective views, respectively, of the flap pocket obtained with the embodiment shown in FIG. 12.
Figure 14:
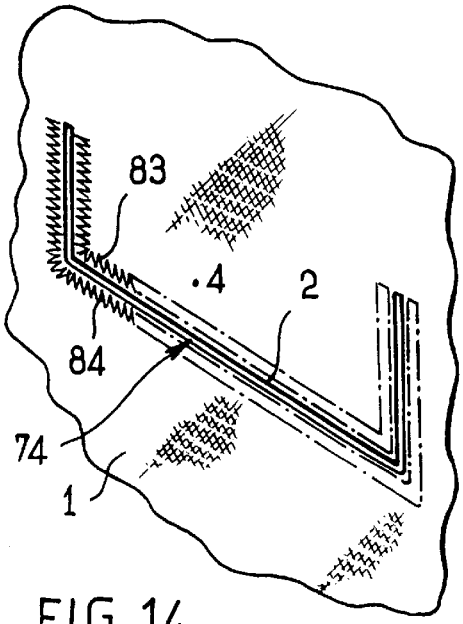

In the example of FIGS. 12 to 14, which will be described only where it differs from the preceding one, the outer panel 78 of the pocket is in one piece having the same dimensions as the inner panel 66. The two panels 66, 77 are intended to be assembled to one another by peripheral stitching 81, along a line shown in dotted line on each of the two panels 66 and 78 of FIG. 12.

Before this assembly, there has been formed in the outer panel 78 a second U-shaped slit 82 whose dimensions correspond with those of the U-shaped slit 2 formed in the item panel 1, whose reverse face can be seen in FIG. 12. The correspondence of dimensions makes it possible for the two slits 2, 82 to be superimposed.

The slit 2 having already been formed in the item panel 1, the actual pocket, formed by the assembled panels 66 and 78, is placed against the item panel 1 in such a way that the outer panel 78 is pressed against the reverse surface of the item panel 1, and that the slits 2 and 82 are superimposed.

Two stitchings, for example in zig-zag form (FIGS. 13 and 14) are then produced, one of them 83 joining the inside edges of the U-shaped slits 2 and 82, and the other 84 joining the outside edges of the U-shaped slits 2 and 82. As shown in FIG. 14, these stitchings can remain visible on the right side of the item panel, but it is possible to conceal at least one of them by means of an added edging.

In this embodiment of the invention, the zone 88 formed in the outside panel 78 inside the U-shaped slit 82 forms a counter flap attached directly to the flap body 4 by the stitching 83. The stitchings 83 and 84 can be the only connections between the actual pocket 66, 78 and the item panel 1.

In this embodiment, the pocket flap 74 has a new function as it is also possible to put a hand into the pocket by pushing the flap towards the inside of the pocket.

The invention is of course not limited to the embodiment described and shown. The flap could have any contour that may be desired for aesthetic or other reasons, for example oval instead of rectangular.

With reference to the embodiment of FIGS. 1 to 11, it is not obligatory to provide a flap edging. For example it would be possible to place an edging around the aperture. Neither is the counter flap obligatory because the upper edge of the pocket could be unattached. The counter flap, if it is provided, could be formed in one piece with the pocket surface. The two pieces 38 and 39 could also be combined in one piece by means of the pocket inner panel which would contiguously join together the upper edge of the upper outer panel and the lower edge of the lower outer panel of the pocket.

The pocket 66, 78 of FIG. 12, provided with a U-shaped slit 82 could be attached to a item panel slit as described with reference to FIGS. 1 to 11. If the aperture of the garment panel is enlarged by the folding back of tabs 34, 35 as described, the U-shaped slit to be made in the outer panel 78 of the pocket must be bigger than the slit 2 formed in the garment panel. But it is possible, on the contrary, to attach an edging along the aperture of the garment panel and to hem the flap body, which would then finally have a size smaller than the U-shaped slit initially formed in the garment panel. In this case the U-shaped slit 32 in the outer panel 78 must have a correspondingly smaller size with respect to the U-shaped slit 2.

I claim:

1. A method for producing a flap pocket, comprising the steps of:

providing an item having a panel;

forming in the item panel a slit having a preselected contour to define a flap;

forming an aperture in the item panel at a location outside of the slit;

and attaching around the aperture a pocket having a lateral opening so that the lateral opening is positioned under the flap.

2. A method according to claim 1; including the step of forming tabs in the item panel and along the slit.

3. A method according to claim 2; wherein the attaching step comprises attaching the pocket to the tabs.

4. A method according to claim 2; wherein the step of forming the slit further comprises forming at least one free end of the slit into a Y shape to define along the aperture one of the tabs and to define the flap between the arms of the Y for folding towards an inner surface of the item panel.

5. A method according to claim 1; including the steps of forming another slit in an outer panel of the pocket to define a counter flap in the outer panel of the pocket, and attaching the counter flap to the flap defined by the slit formed in the item panel.

6. A method according to claim 5; including the steps of superimposing and stitching outer edges of the slit formed in the outer panel of the pocket and the slit formed in the item panel so that the pocket is attached around the aperture and the stitching is disposed on an outer face of the item panel.

7. A method according to claim 1; wherein the slit has a pair of leg portions connected at one end thereof to define the preselected contour of the slit.

8. A method according to claim 7; wherein the preselected contour of the slit is generally U-shaped.

9. A method for producing a flap pocket in a panel of an item, comprising the steps:

forming in a panel of an item a generally U-shaped slit to define a flap having a flap body integral with the item panel and at a location inside of the U-shaped slit;

forming an aperture in the item panel at a location outside of the U-shaped slit;

and attaching around the aperture a pocket having a lateral opening positioned under the flap.

10. A method according to claim 9, including the steps of forming tabs in the item panel and along the U-shaped slit so that the tabs are turned back towards an inner surface of the item; and attaching the pocket around the aperture by attaching the pocket to the tabs.

11. A method according to claims 9 or 10; including the step of attaching a flap edging along mobile edges of the flap body.

12. A method according to claims 9 or 10; including the step of attaching a flap edging along mobile edges of the flap body to enlarge the flap to a dimension greater than the dimension of the U-shaped slit.

13. A method according to claim 10; wherein the U-shaped slit is formed by forming at least one free end of the U-shaped slit into a Y shape to define along the aperture one of the tabs which is turned back towards the inner surface of the item, to define a flap tab along the flap body, and to define a neatness flap between the arms of the Y for folding towards an inner surface of the item panel.

14. A method according to claim 13; further comprising attaching a flap edging to the flap body so that the flap edging extends beyond each free end of the U-shaped slit and is engaged behind the item panel.

15. A method according to claim 14; including the step of attaching a counter flap to the flap edging so that the counter flap covers an inner face of the flap body.

16. A method according to claims 9 or 10; including the step of attaching a counter flap to an inner face of the flap body.

17. A method according to claim 16; including the step of attaching the pocket to the counter flap in the vicinity of or above a line substantially corresponding to an axis of articulation of the flap with the item panel.

18. A method according to claims 9 or 10; wherein the pocket is formed by attaching around the aperture an upper face panel and a lower face panel of the pocket each connected by a 180° fold with one of an upper outer panel and a lower outer panel of the pocket such that the folds are turned towards each other to define the lateral opening of the pocket, and thereafter attaching a pocket inner panel to the periphery of the assembly formed by the upper outer panel and the lower outer panel of the pocket.

19. A method according to claims 9 or 10; including the step of forming a second generally U-shaped slit in an outer panel of the pocket to define a counter flap in the outer panel of the pocket and to define the lateral opening of the pocket, and attaching the counter flap, at least indirectly, to the flap body.

20. A method according to claim 19, wherein the second U-shaped slit is formed with dimensions which allow the second U-shaped slit to be superimposed on the U-shaped slit formed in the item panel; and including the step of superimposing and stitching the outside edges of the U-shaped slit formed in the item panel and the second U-shaped slit to attach the pocket around the aperture such that the stitching appears on an outer face of the item panel.

21. A method according to claim 19; wherein the second U-shaped slit is formed with dimensions which allow the second U-shaped slit to be superimposed on the U-shaped slit formed in the item panel; and including the step of superimposing and stitching the inside edges of the U-shaped slit formed in the item panel and the second U-shaped slit in order to attach the counter flap to the flap body such that the stitching appears on an outer face of the flap.

22. An item comprising a flap pocket obtained by a method according to claims 9 or 10; wherein the flap body of the flap is integral with the pocket, and the aperture is disposed under the flap.

23. An item according to claim 22; wherein the flap pocket further comprises a flap edging connected to the flap body.

24. An item according to claim 22; wherein the flap pocket further comprises tabs provided in the item panel along the aperture and turned towards the inside of the item, the pocket being connected to the tabs.

25. An item according to claim 24; wherein the counter flap is connected to an inner face of the flap body, and the pocket is connected to the counter flap.

26. An item according to claim 25; wherein the pocket comprises at least one face panel for closing the aperture under the flap with the exception of the lateral opening which provides access into the pocket.

27. An item according to claim 25; wherein the pocket comprises two pieces of material folded through 180° to form a pair of folds defining therebetween the lateral opening (63) of the pocket, each piece of material defining an upper and a lower outer panel of the pocket and an upper and a lower face panel of the pocket, the face panels closing the aperture behind the flap except for the lateral opening.

28. An item according to claim 25; wherein the pocket comprises an outer panel having a generally U-shaped slit defining a counter flap located inside of said U-shaped slit and connected to an inner face of the flap body.

29. A flap pocket formed in a panel of an item, comprising:

means defining a generally U-shaped slit in a panel of an item to define a flap body integral with the item panel and located inside of the U-shaped slit;

means defining an aperture in a region outside of the U-shaped slit; and a pocket connected around the aperture and having a lateral opening positioned under the flap body.

30. A flap pocket according to claim 29; further comprising tabs provided in the item panel along the U-shaped slit and being turned back towards an inner surface of the item panel.

31. A flap pocket according to claim 29; further comprising a second generally U-shaped slit disposed in an outer panel of the pocket to define a counter flap and to define the lateral opening of the pocket, the counter flap being connected to the flap body.

32. A flap pocket according to claim 31; wherein the second U-shaped slit is superimposed and stitched to outer edges of the U-shaped slit in the item panel to thereby connect the pocket around the aperture and on an outer face of the item panel.

* * * * *